US006714484B2

(12) United States Patent
Ladabaum et al.

(10) Patent No.: US 6,714,484 B2
(45) Date of Patent: Mar. 30, 2004

(54) MICROFABRICATED ACOUSTIC TRANSDUCER WITH SUPPRESSED SUBSTRATE MODES

(75) Inventors: Igal Ladabaum, San Carlos, CA (US); Paul A. Wagner, San Francisco, CA (US)

(73) Assignee: Sensant Corporation, San Leandro, CA (US)

( * ) Notice: Subject to any disclaimer, the term of this patent is extended or adjusted under 35 U.S.C. 154(b) by 0 days.

(21) Appl. No.: 10/280,317

(22) Filed: Oct. 25, 2002

(65) Prior Publication Data

US 2003/0103412 A1 Jun. 5, 2003

Related U.S. Application Data

(62) Division of application No. 09/971,095, filed on Oct. 3, 2001.
(60) Provisional application No. 60/242,298, filed on Oct. 19, 2000.

(51) Int. Cl.[7] ..... H04R 17/00
(52) U.S. Cl. ..... 367/176; 367/162; 367/163; 367/174; 367/181
(58) Field of Search ..... 310/322, 328, 310/331; 367/162, 163, 174, 176, 181

(56) References Cited

U.S. PATENT DOCUMENTS

| | | | | |
|---|---|---|---|---|
| 4,494,091 A | | 1/1985 | Goll | 333/151 |
| 4,528,652 A | * | 7/1985 | Horner et al. | 310/327 |
| 5,287,331 A | | 2/1994 | Schindel et al. | 367/140 |
| 5,619,476 A | | 4/1997 | Haller et al. | 367/181 |
| 5,730,113 A | | 3/1998 | Wildes et al. | 125/13.01 |
| 5,870,351 A | | 2/1999 | Ladabaum et al. | 367/163 |
| 5,877,580 A | * | 3/1999 | Swierkowski | 310/328 |
| 5,894,452 A | | 4/1999 | Ladabaum et al. | 367/163 |
| 5,982,709 A | | 11/1999 | Ladabaum et al. | 367/174 |
| 6,004,832 A | | 12/1999 | Haller et al. | 438/50 |
| 6,295,247 B1 | * | 9/2001 | Khuri-Yakub et al. | 367/140 |

FOREIGN PATENT DOCUMENTS

DE 199 28 596 1/2000

OTHER PUBLICATIONS

Sleva et al., "A Micromachined Poly(vinylidene fluoride–trifluoroethylene) Transducer for Pulse–Echo Ultrasound Applications", IEEE Transactions on Ultrasonics, Ferroelectrics, and Frequency Control, vol. 43, No. 2, Mar. 1996.*

Jin et al., "Micromachined Capacitive Transducer Arrays for Medical Ultrasound Imaging", Proc. Ultrasonic Symposium, pp. 1877–1880, 1998.*

Khuri–Yakub et al., "Silicon Micromachined Ultrasonic Transducers", Proc. Ultrasonic Symposium, pp. 985–991, 1998.*

Ladabaum et al, "Micromachined Ultrasonic Transducers (MUTs)"; 1995 IEEE Ultrasonic Symposium, pp. 501–504.

* cited by examiner

*Primary Examiner*—Ian J. Lobo
(74) *Attorney, Agent, or Firm*—Pillsbury Winthrop LLP

(57) ABSTRACT

A microfabricated acoustic transducer with suppressed substrate modes includes a diaphragm containing an upper electrode suspended above a substrate containing a lower electrode; the substrate may or may not contain electronic circuits. The substrate modes are suppressed by either thinning the substrate such that a longitudinal ringing mode occurs outside of the frequency band of interest or applying a judiciously designed damping material that absorbs acoustic energy from the substrate on the backside of the transducer substrate, or by both thinning the substrate and applying the damping material. The damping material has an acoustic impedance that matches the acoustic impedance of the substrate and is lossy.

10 Claims, 6 Drawing Sheets

Transmission Test
(pitch and catch)

Sample 9 MHz Immersion Parts → Backing Material Effects

Time Response
Vbias = 90V
Vac = 10V 30ns pulse
2mm separation
No backing material
Medium = water 2-way Insertion Loss
-6dB BW = 78.82%

MICROFABRICATED ACOUSTIC TRANSDUCER WITH SUPPRESSED SUBSTRATE MODES

CROSS-REFERENCE TO RELATED APPLICATIONS

This is a divisional of application Ser. No. 09/971,095 filed Oct. 3, 2001 pending.

This invention claims priority based on U.S. Provisional Application No. 60/242,298 filed Oct. 19, 2000, entitled "Microfabricated Ultrasonic Transducer with Suppressed Substrate Modes."

BACKGROUND OF THE INVENTION

1. Field of the Invention

The present invention relates to the field of acoustic transducers. More specifically, the present invention relates to capacitive microfabricated ultrasonic transducers.

2. Description of the Related Art

An acoustic transducer is an electronic device used to emit and receive sound waves. Acoustic transducers are used in medical imaging, non-destructive evaluation, and other applications. Ultrasonic transducers are acoustic transducers that operate at higher frequencies. Ultrasonic transducers typically operate at frequencies exceeding 20 kHz.

The most common forms of ultrasonic transducers are piezoelectric transducers. Recently, a different type of ultrasonic transducer, capacitive microfabricated transducers, have been described and fabricated. Such transducers are described by Haller et al. in U.S. Pat. No. 5,619,476 entitled "Electrostatic Ultrasonic Transducer," issued Apr. 9, 1997, and Ladabaum et al. in U.S. Pat. No. 5,870,351 entitled "Broadband Microfabricated Ultrasonic Transducer and Method of Fabrication," issued Feb. 9, 1999. These patents describe transducers capable of functioning in a gaseous environment, such as air-coupled transducers. Ladabaum et al, in U.S. Pat. No. 5,894,452 entitled, "Microfabricated Ultrasonic Immersion Transducer," issued Apr. 13, 1999 describe an immersion transducer (a transducer capable of operating in contact with a liquid medium), and in U.S. Pat. No. 5,982,709 entitled, "Acoustic Transducer and Method of Microfabrication," issued Nov. 9, 1999 describe improved structures and methods of microfabricating immersion transducers. The basic transduction element described by these patents is a vibrating capacitor. A substrate contains a lower electrode, a thin diaphragm is suspended over said substrate, and a metalization layer serves as an upper electrode. If a DC bias is applied across the lower and upper electrodes, an acoustic wave impinging on the diaphragm will set it in motion, and the variation of electrode separation caused by such motion results in an electrical signal. Conversely, if an AC signal is applied across the biased electrodes, an AC forcing function will set the diaphragm in motion, and this motion emits an acoustic wave in the medium of interest.

It has been realized by the present inventors that the force on the lower (substrate) electrode cannot be ignored. Even though the diaphragm is much more compliant than the substrate and thus moves much more than the substrate when an AC voltage is applied between the biased electrodes, the substrate electrode experiences the same electrical force as the diaphragm electrode. Thus, when transmitting, a microfabricated ultrasonic transducer can launch acoustic waves in the substrate as well as in the medium of interest, even though the particle motion in the substrate is smaller than the particle motion in the fluid medium of interest. Of particular concern is the situation where the substrate has mechanical properties and a geometry such that resonant modes can be excited by the force on the substrate electrode. In these cases, the acoustic activity of the substrate can undermine the performance of the transducer. One specific example is a longitudinal ringing mode that can be excited in a typical silicon substrate wafer. Since the detrimental effects on transducer performance of the forces and motion of the substrate electrode have not been previously addressed, there is the need for an ultrasonic transducer capable of operating with suppressed substrate modes.

While the suppression of modes, matching, and the damping of acoustic energy exists in piezoelectric transducers, the differences between such piezoelectric transducers and microfabricated ultrasonic transducers are so numerous that heretofore suppression of modes, matching and damping was not considered relevant to microfabricated ultrasonic transducers.

SUMMARY OF THE INVENTION

It is an object of the present invention to provide microfabricated acoustic or ultrasonic transducer with suppressed substrate acoustic modes.

It is a further object of the present invention to provide an acoustic or ultrasonic transducer with suppressed substrate acoustic modes when the substrate is a silicon wafer containing integrated electronic circuits.

It is a further object of the present invention to provide an acoustic damping material placed on the back side of the substrate, said backing material capable of dissipating the acoustic energy in the substrate.

It is a further object of the present invention to provide a thinned substrate so that acoustic modes in the substrate can exist only at frequencies outside the band of interest.

It is a further object of the present invention to provide a specific material capable of suppressing modes in a silicon substrate.

The present invention achieves the above objects, among others, with an acoustic or ultrasonic transducer comprised of a diaphragm containing an upper electrode suspended above a substrate containing the lower electrode, a substrate that may or may not contain electronic circuits, and a backing material that absorbs acoustic energy from the substrate. Further, the substrate can be thinned to dimensions such that, even without any backing material, resonant modes are outside of the frequency band of interest.

In order to obtain a suitable backing material to dampen the acoustic energy in the substrate is twofold, certain characteristics are preferably met. First, the material should have an acoustic impedance that matches that of the substrate. This allows acoustic energy to travel from the substrate into the backing material (as opposed to getting reflected into the substrate at the substrate-backing interface). Second, the material should be lossy. This allows for the energy that enters the backing material from the substrate to be dissipated. In one preferred embodiment of the invention, a tungsten epoxy mixture is used to successfully damp the longitudinal ringing mode in a 640 $\mu$m silicon substrate by applying the material to the backside of the substrate (the side opposite the transducer diaphragms).

BRIEF DESCRIPTION OF THE DRAWINGS

The features, objects and advantages of the present invention will become more apparent from the detailed description set forth below when taken in conjunction with the drawings in which like reference characters identify correspondingly throughout and wherein.

DETAILED DESCRIPTION OF THE PREFERRED EMBODIMENTS

Reference will now be made in detail to the preferred embodiments of the invention, examples of which are illustrated in the accompanying drawings. While the invention will be described in conjunction with the preferred embodiments, it will be understood that they are not intended to limit the invention to those embodiments. On the contrary, the invention is intended to cover alternatives, modifications and equivalents, which may be included within the spirit and scope of the invention as defined by the appended claims.

Figure 1A:
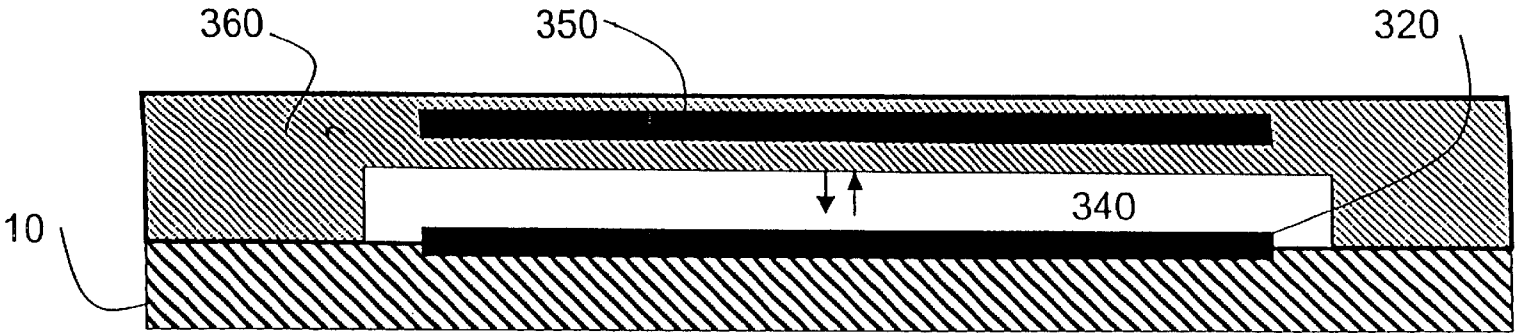
FIG. 1A illustrates a cross-section of one cell of a conventional capacitive microfabricated transducer.
Figure 1B:
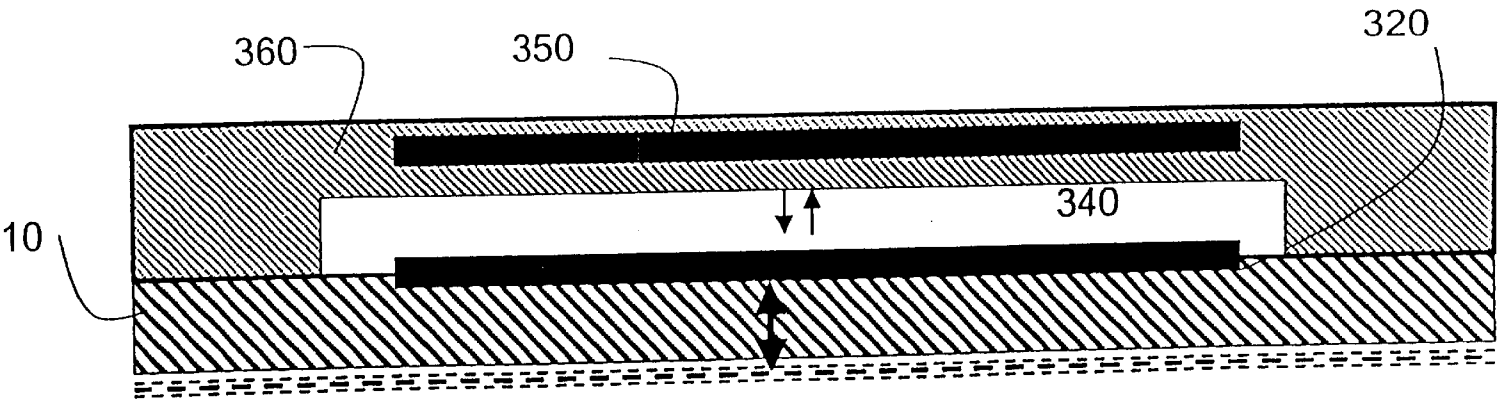
FIG. 1B illustrates the concept of a force on the lower electrode causing a ringing mode.

FIGS. 1A and 1B illustrate a cross-section of one cell of a capacitive microfabricated acoustic or ultrasonic transducer, and the concept of launching a substrate mode. A transducer cell includes, among others, a diaphragm 360 with a top electrode 350, a cavity 340, a lower electrode 320 on a substrate 10. When a bias and an alternating voltage are applied across electrodes 320 and 350, an time-varying attractive force sets the diaphragm 360 in motion, which launches an acoustic wave in the medium of interest. The force on electrode 350 is identical to the force on electrode 320, however, and thus a mode can be excited in the substrate 10 such as the longitudinal resonant mode depicted in FIG. 1B.

Figure 2A:
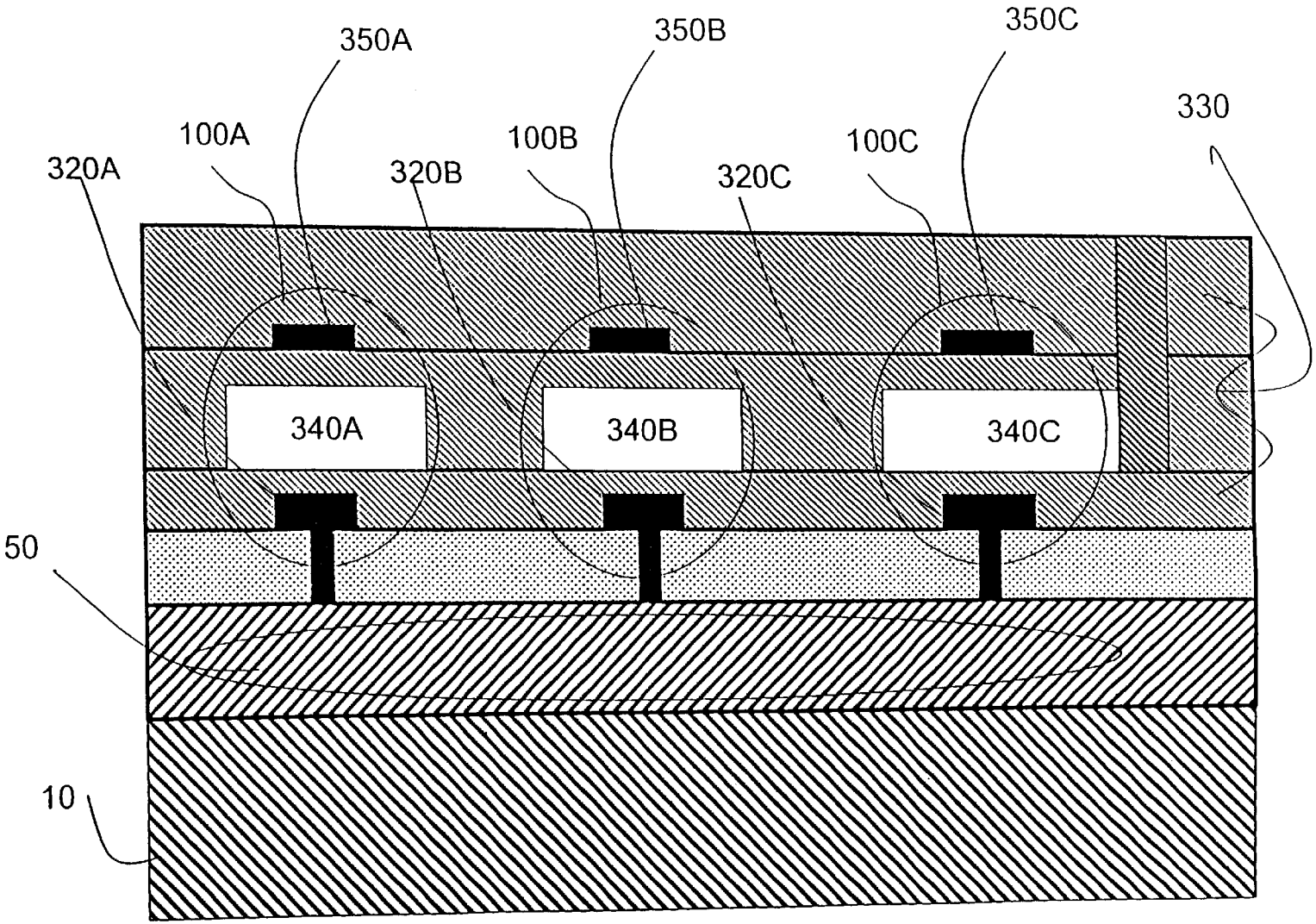
FIGS. 2A and 2B illustrate a cross-sectional and top view, respectively, of a capacitive microfabricated transducer formed over integrated circuits.
Figure 2B:
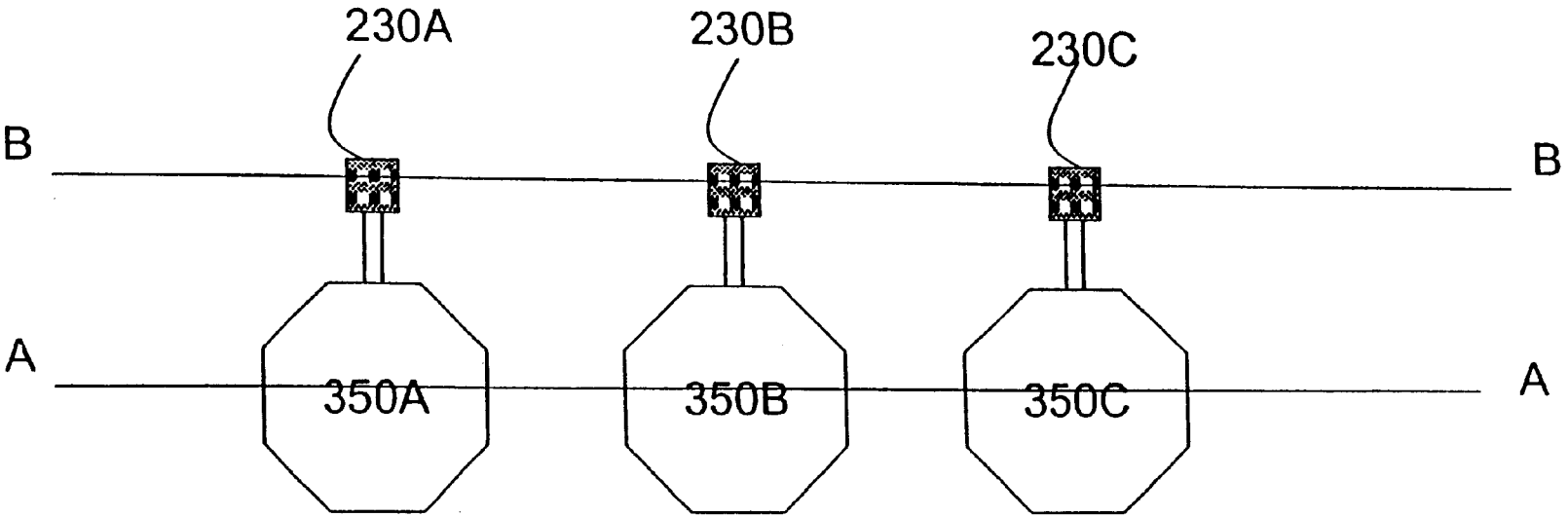

FIGS. 2A and 2B illustrate one embodiment of a part of an array of acoustic or ultrasonic transducers formed over circuit devices on the same integrated circuit. FIG. 2B illustrates a top view at the top electrode level that shows the relative placement of the top electrodes 350A, 350B and 350C of the transducers 100A, 100B and 100C, respectively, in relation to certain interconnects 230A, 230B and 230C, described further hereinafter. The cross section of FIG. 2A can be seen from the line A—A shown in FIG. 2B and illustrates circuit components 50 formed in the semiconductor substrate 10. The circuit components 50 can form a variety of circuit functions. Examples include analog circuits such as amplifiers, switches, filters, and tuning networks, digital circuits such as multiplexors, counters, and buffers, and mixed signal circuits (circuits containing both digital and analog functions) such as digital-to-analog and analog-to-digital converters. Disposed over the circuit components 50 are transducers, such as the illustrated transducers 100A, 100B and 100C. Transducers 100A, 100B and 100C are shown as being composed of a single transducer cell 200A, 200B and 200C, respectively. Of course the transducers 100 may have as few as one or many more than three, such as hundreds or thousands, transducer cells 200 associated with them. Many such transducers 100 will typically be formed at the same time on a wafer, with the wafer cut into different die as is known in the art. A further description of such a transducer can be found in pending U.S. Pat. No. 6,246,158 entitled, "Microfabricated Transducers Formed Over Other Circuit Components on an Integrated Circuit Chip and Methods for Making the Same," filed Jun. 24, 1999. Other variations of microelectronic microfabricated immersion transducers are described in U.S. Pat. No. 6,271,620 entitled, "Acoustic transducer and method of making same," filed May 20, 1999 by Ladabaum.

Figure 3:
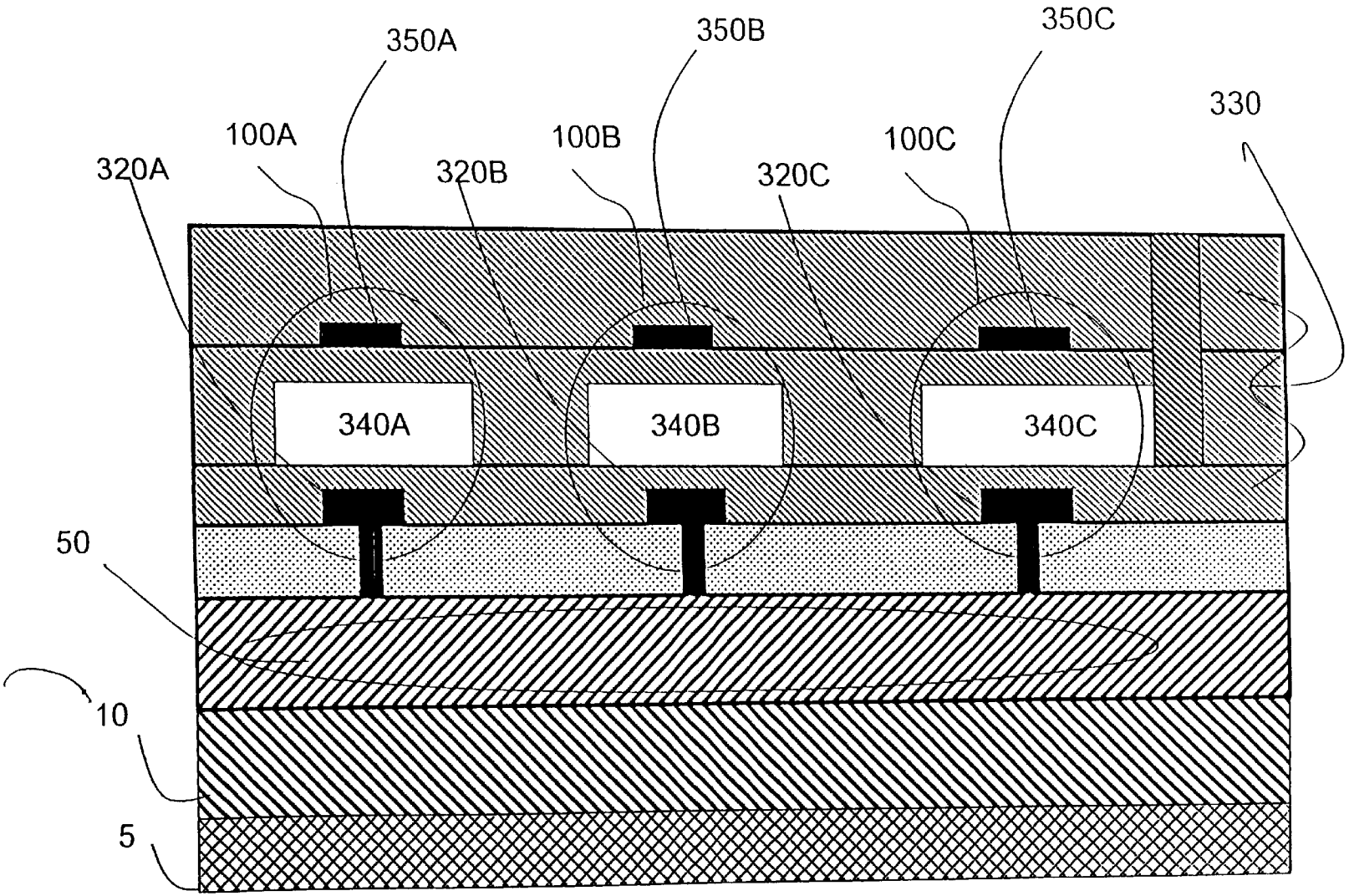
FIG. 3 is a cross-sectional view of a microfabricated transducer with damping material according to a preferred embodiment of the present invention.

A preferred embodiment of the present invention will first be described with respect to FIG. 3. It should be noted that FIG. 3 is not drawn to geometrical scale, but serves only as a conceptual sketch. In FIG. 3, a backing material layer 5 is disposed beneath the substrate 10. This backing material, if it has a substantially similar acoustic impedance to that of substrate 10, is lossy, and is of sufficient thickness to dissipate the acoustic energy in the substrate 10, will suppress any ringing mode in the substrate 10. Of significance to this embodiment is the fact that electronic circuit components 50 are present in the substrate 10, that the capacitive transducers 100 are formed over the electronic circuit components, and that the backing layer 5 is disposed beneath the substrate 10.

In another preferred embodiment of the present invention, substrate 10 can be made thinner such that the longitudinal mode of the substrate occurs outside of the frequency band of interest, either with our without the use of a backing material. For example, of significance is that the first longitudinal ringing mode of a silicon substrate 640 microns thick occurs at approximately 7 MHz. Thus, a preferred embodiment in which a 10 MHz center frequency diaphragm design is not perturbed by substrate ringing modes is characterized by a substrate thickness of approximately 210 microns. At 210 microns, the first longitudinal ringing mode occurs at approximately 21 MHz, well out of the 10 MHz frequency band of interest.

Figure 4A:
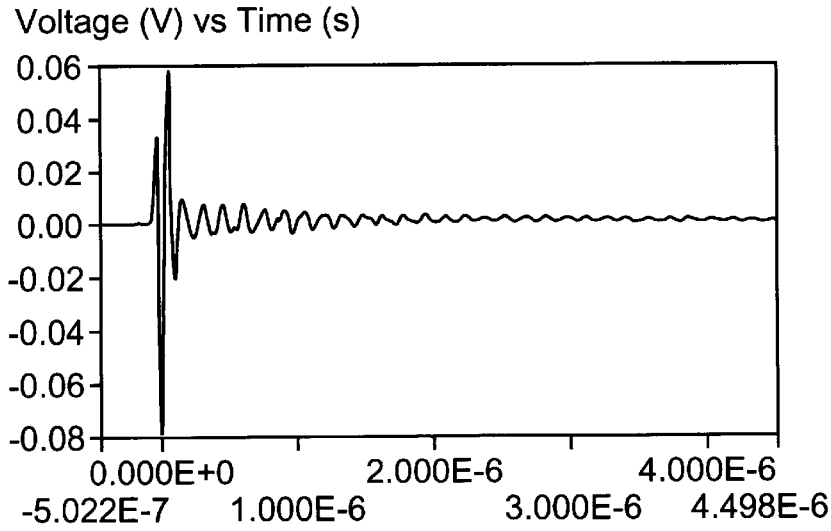
FIGS. 4A–4D illustrate the experimental results obtained from applying a backing material to a microfabricated ultrasonic transducer.
Figure 4B:
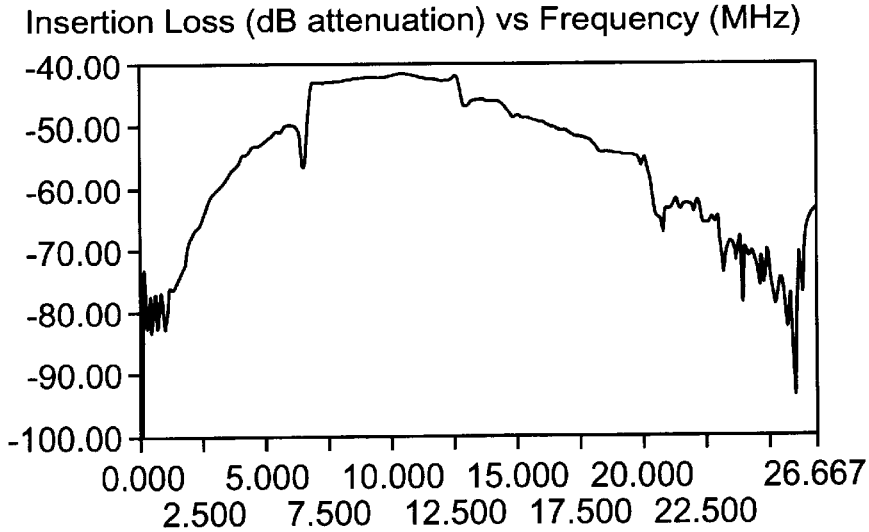
Figure 4C:
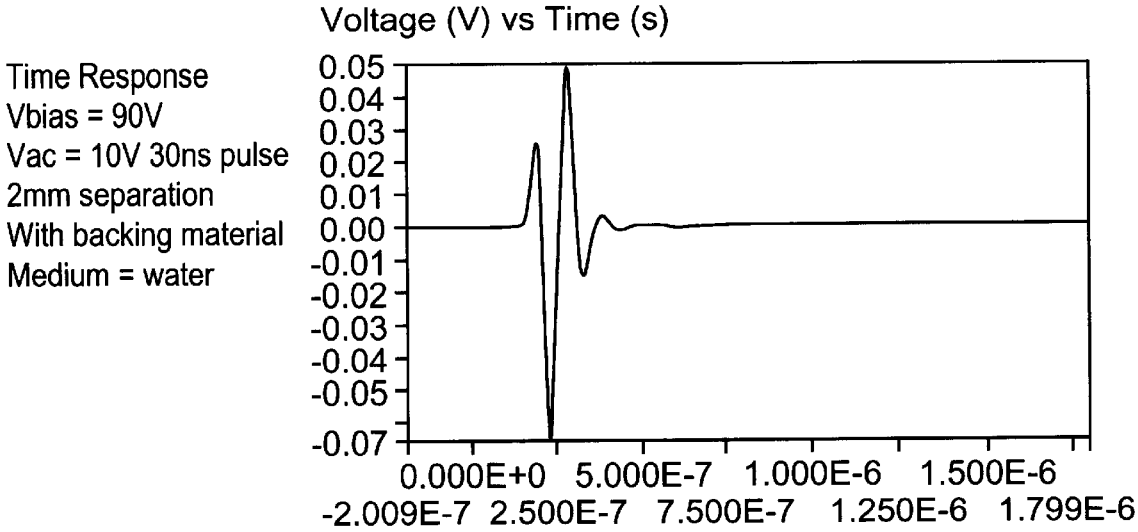
Figure 4D:
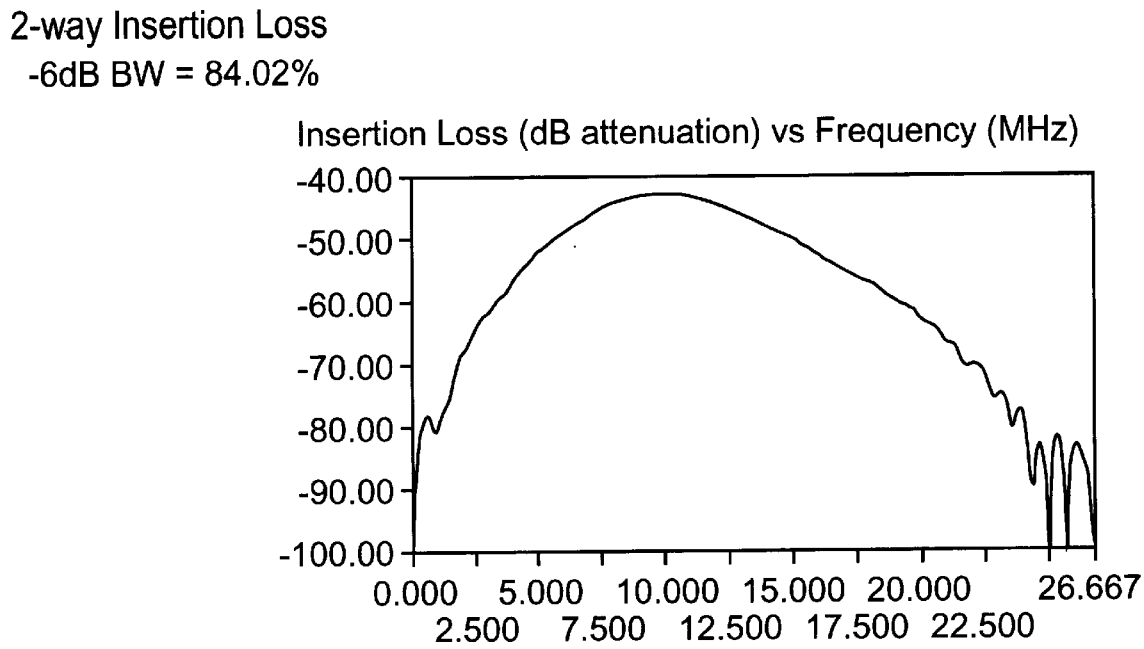

FIGS. 4A–4D illustrate the experimental results of a preferred embodiment of the present invention. In this embodiment, capacitive transducers operating with a center frequency of 10 MHz were designed, and the transducer thus operates in the ultrasonic range. As is evident in the result of a pitch-catch transmission test of two identical transducers without backing, there is a longitudinal ringing mode in the 640 micron silicon substrate at approximately 7 MHz and subsequent harmonics. FIG. 4A is the time domain waveform of the received signal and FIG. 4B is the frequency domain waveform of the ratio of the transmitted to received signal. The ringing is evident in the sinusoidal tail of FIG. 4A and the frequency content of the ringing is evident in the insertion loss plot of FIG. 4B. FIGS. 4C and 4D contain the results of the same transmission pitch catch experiment after backing material was applied to both transducers. These figures illustrate that the ringing mode has been eliminated.

The backing material used in this embodiment was a 20-1 weight mixture of 20 um spherical tungsten powder and epoxy. This mixture was empirically derived in order to match the acoustic impedance of the silicon substrate and to be very lossy. Furthermore, it forms a good bond with the silicon substrate. A thickness of 1 mm of backing material was applied to the backside of the silicon substrate. Of course, other lossy material can be used, particularly if matched with the acoustic impedance of the substrate.

The present invention, as described hereinabove, thus provides for the suppression of acoustic modes by placing a judiciously designed damping material on the backside of electronics, something that cannot be achieved with piezoelectric transducers that require mode suppression to occur directly at the piezoelectric surface. The present invention also advantageously provides for thinning the substrate in order to ensure that the substrate modes are outside of the frequency range of interest, which also cannot be achieved with piezoelectric transducers because the dimensions of piezoelectrics define their frequency range.

Accordingly, while the present invention has been described herein with reference to particular embodiments thereof, a latitude of modification, various changes and substitutions are intended in the foregoing disclosure. For example, only certain features and not others of the present invention can be used to suppress acoustic modes and still be within the intended scope of the present invention. Accordingly, it will be appreciated that in some instances some features of the invention will be employed without a corresponding use of other features without departing from the spirit and scope of the invention.

We claim:

1. A microfabricated transducer assembly with suppressed acoustic modes comprising:

a substrate having a topside, a backside and a thickness;

a capacitive microfabricated ultrasonic transducer formed on the topside of the substrate;

a damping material disposed on the backside of the substrate; and wherein:

the thickness of the substrate is such that longitudinal ringing modes of the substrate are outside a frequency band of interest;

the damping material is lossy; and the damping material has an acoustic impedance substantially equal to that of the substrate.

2. The apparatus according to claim 1 further including electronic circuits formed in the substrate.

3. The apparatus according to claim 1 wherein:

the thickness of the substrate is less than 210 microns; and the frequency band of interest includes a center frequency of approximately 10 Mhz.

4. The apparatus according to claim 3 wherein:

the substrate is silicon; and the backing material is a mixture of 20 micron spherical powder and epoxy, the mixture being at a ratio of 20 to 1 by weight.

5. The apparatus according to claim 4 wherein the backing material is disposed on the backside of the substrate to a depth of approximately 1 mm.

6. A method for suppressing acoustic modes in a microfabricated transducer assembly, the method comprising:

providing a substrate having a topside, a backside and a thickness;

forming a capacitive microfabricated ultrasonic transducer formed on the topside of the substrate;

disposing a damping material disposed on the backside of the substrate; and wherein:

the thickness of the substrate is such that longitudinal ringing modes of the substrate are outside a frequency band of interest;

the damping material is lossy; and the damping material has an acoustic impedance substantially equal to that of the substrate.

7. The method of claim 6 further including electronic circuits formed in the substrate.

8. The method of claim 6 wherein:

the thickness of the substrate is less than 210 microns; and the frequency band of interest includes a center frequency of approximately 10 MHz.

9. The method of claim 8 wherein the backing material is a mixture of 20 micron spherical powder and epoxy, the mixture being at a ratio of 20 to 1 by weight.

10. The method of claim 9 wherein:

the substrate is silicon; and the backing material is a mixture of 20 micron spherical powder and epoxy, the mixture being at a ratio of 20 to 1 by weight.

* * * * *